United States Patent [19]

Velikov et al.

[11] 4,272,198

[45] Jun. 9, 1981

[54] DEVICE FOR THE DISPERSION OF CEMENT SOLUTIONS

[75] Inventors: Dancho N. Velikov, St. Zagora; Kancho T. Kanchev, Gabrovo; Stanislav A. Ivanov, Sofia; Ilye H. Ivanov; Hristo D. Tepavicharov, both of Gabrovo, all of Bulgaria

[73] Assignee: VMEI (Vish Maschinno-Elektrotechnicheski Institute), Gabrovo, Bulgaria

[21] Appl. No.: 43,011

[22] Filed: May 29, 1979

[30] Foreign Application Priority Data

May 26, 1978 [BG] Bulgaria ..... 39860

[51] Int. Cl.[3] ..... B28C 5/08

[52] U.S. Cl. ..... 366/65

[58] Field of Search ..... 366/64, 65, 66, 33, 366/40, 177, 244, 245, 251, 279, 341, 343, 128, 282, 605

[56] References Cited

U.S. PATENT DOCUMENTS

| | | | |
|---|---|---|---|
| 1,124,452 | 1/1915 | Jacobson | 366/65 |
| 3,020,029 | 2/1962 | Fejmert | 366/65 |
| 3,081,983 | 3/1963 | Thibodeaux | 366/65 |
| 3,215,412 | 11/1965 | Kindler | 366/65 |

*Primary Examiner*—Edward J. McCarthy

[57] ABSTRACT

A device for dispersing of cement such as Portland cement in water to form a solution or dispersion thereof. The device includes a barrel with coaxially arranged wheel and director therein. Upon the hub of the wheel and parallel to its center line wedge-shaped blades are mounted circularly, thereabout the sharp edge of the wedge-shaped blades being oriented in the direction of rotation of the wheel and the radially outer side of the wedge-shaped blades forming acute angles with the direction of movement of the blades. Each acute angle lies between 5° and 30°, and the peripheral speed of the wheel lies in the range of from 10 m/sec to 25 m/sec.

5 Claims, 3 Drawing Figures

DEVICE FOR THE DISPERSION OF CEMENT SOLUTIONS

This invention relates to a device for the mixing (dispersion) of cement solutions, which finds its application in the production of concrete—a principal material of construction.

There is known a device for the mixing of cement solutions, which consists of a barrel, in which, along its axis there is mounted a spindle with a wheel. The wheel is equipped with axial helical blades, which have a spatial wedge shape, by which cavitational erosion is avoided. A director is placed under the inlet opening. The spindle with the wheel is driven by such as an electric motor.

Disadvantages of the above said device consist both of difficulties in manufacturing the bladed wheel due to its complex spatial configuration, and its large overall dimensions, which present an obstacle to inserting the device into the equipment for concrete production.

The object of this invention is to provide a device for the dispersion of cement solutions, in which the operating element—the bladed wheel—is protected against cavitational erosion and is of both simplified configuration and reduced overall dimensions, which facilitate its being used in the operating cycle of a system for concrete production.

This object is fulfilled by the device for dispersing cement solutions, in accordance with the present invention. Such device has a vertical barrel with a wheel along its central axis. Above the wheel and coaxial therewith there is disposed a director for material directing. On the hub of the wheel and parallel to the wheel axle, wedge-shaped blades are provided. The sharp leading edge of the wedge is oriented along the direction of rotation of the wheel, and the radially outer side of the wedge, outwardly with respect to the axis of rotation, forms an acute angle with the direction of movement of the blades.

The acute angle between the outer side of the blades and the direction of their movement lies in the range of from 5° to 30°, and the peripheral speed of the wheel lies in the range of from 10 to 25 m/sec.

Among the advantages of the invention are the simplified shape of the blades while preserving the positive effect of removing cavitational erosion from the same, as well as the reduced overall dimensions of the device, thus allowing ready insertion of the device into the system of equipment for concrete production. The principal advantage of the invention is that the selected wedge shape of the blades and their arrangement along the wheel create conditions not only for avoiding cavitational erosion of the same, but also for turning the cavitation from a negative phenomenon to a positive one. In this way, a substantial cost saving in the production of cement, a principal construction material, is realized.

In the accompanying drawings, which illustrate a preferred embodiment of the invention:

Figure 1:
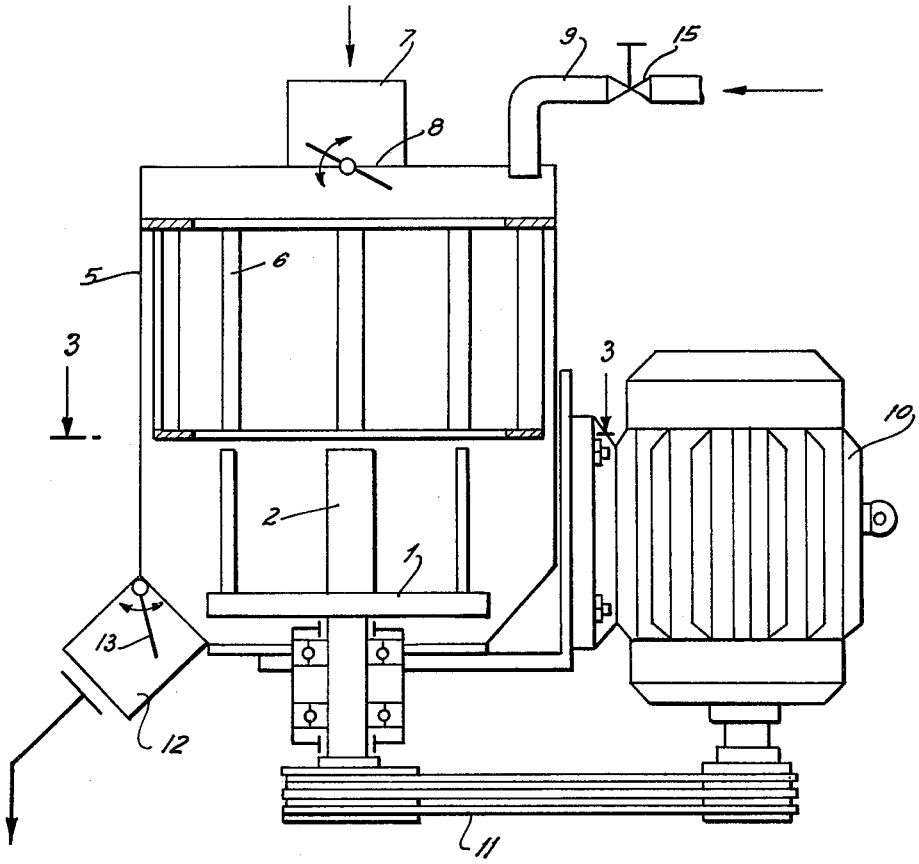
FIG. 1 is a view in side elevation of the device of the invention, certain of the parts being shown in side elevation.
Figure 2:
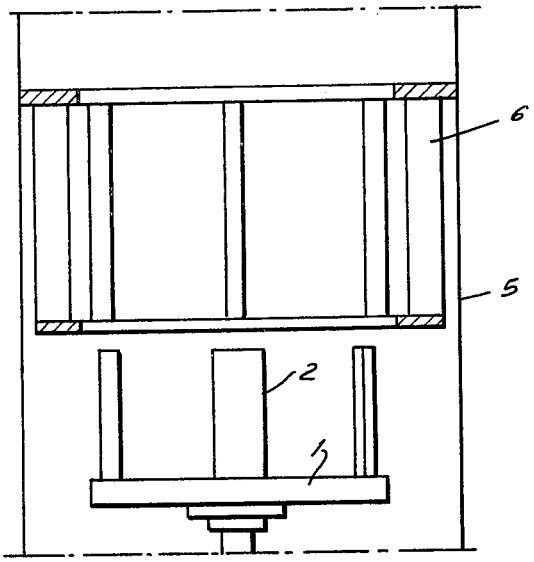
FIG. 2 is a fragmentary view in cross section of the device on an enlarged scale.
Figure 3:
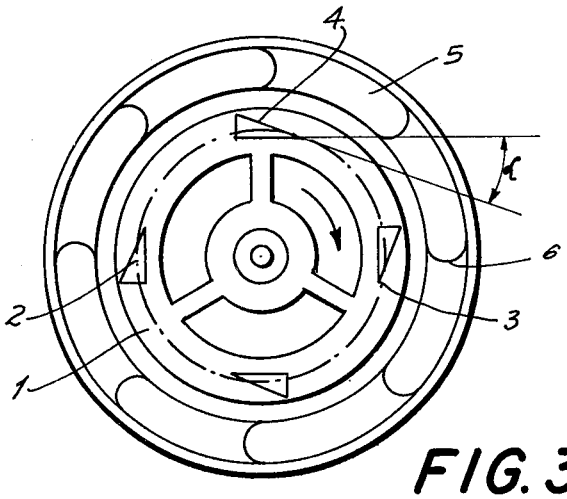
FIG. 3 is a view in transverse section along line 3 in FIG. 1.

The device according to the invention has a spindle with a wheel 1, on the hub of which vertical blades 2 of wedge shape are mounted circularly. The sharp leading or front edge 3 of each of the wedge-shaped blades 2 is oriented along the direction of rotation of the wheel 1. The radially outer side 4 of the wedge-shaped profile of the blade 2, which side is outwardly with respect to the axis of rotation of wheel 1, forms an acute angle $\alpha$ with the direction of movement (clockwise in FIG. 3) of blades 2. The acute angle $\alpha$ has a value in the range of from 5° to 30°. The spindle with the wheel 1 is located along the central axis of a vertical barrel 5. Above the wheel 1 and coaxial thereof, a fixed annular member or director 6 is mounted. At the top end of the barrel 5 and above the director 6, there is an inlet opening 7 for cement such as Portland cement, which opening is equipped with a control valve 8. Near the inlet opening 7 for cement, there is an inlet opening 9 for water, said openings being connected to a cement-containing silo and a water source, respectively. Member 6 has a plurality of blades of scoop cross section (FIG. 3) for directing the Portland cement and water toward the blades 2 of the wheel 1.

The wheel 1 is driven by an electric motor 10 through a belt drive 11. The peripheral speed of the wheel is from 10 to 25 m/sec. At the bottom end of the barrel 5 there is provided a discharge opening 12 with a valve 13 for the dispersed mixture.

The above-described device operates as follows:

The motor 10 through the belt drive 11 drives the spindle to which the wheel 1 is secured. Preliminary dosed quantities of cement and water are fed through the inlet openings 7 and 9, respectively, when the valves 8 and 15 are opened and the valve 13 of the discharge opening 12 is closed. The cement and the water fall upon the director 6, which directs their compenents to the blades 2 of the wheel 1. When the wheel 1 is rotating, a spatial supercavitational flow is created in the barrel 5 as a result of which the cement is finely dispersed in the solution. Conditions for supercavitation are created due to both a properly selected angle $\alpha$ and the peripheral speed of the blades 3, which speed is in the range of 10 m/sec. to 25 m/sec. The time required for the dispersion of the solution is in the order of 10 to 40 sec. The proper values of the parameters of angle, speed and time depend on the corresponding grade of concrete.

After a predetermined period of time, the valve 13 opens and thus the dispersed solution, through the discharge opening 12, enters the mixer of the concrete making system, where it is mixed with inert materials such as sand and gravel required for preparing the respective grade of concrete. The whole process described above is repeated at regular intervals.

The fine dispersion of the cement with water contributes to the increasing of the strength of the concrete by 20% to 30%. Thus, a substantial cost saving of a principal building material and a superior concrete are realized.

When the device operates, cavitational erosion is avoided, because the cavitational bubbles act in the region of the solution but not over the surface of the blades 2.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

We claim:

1. A device for forming and dispersing cement solutions, comprising a vertical barrel, a wheel mounted to rotate about a vertical axis within the barrel generally coaxial thereof and adjacent the bottom thereof, the wheel having a hub, a plurality of first blades mounted on the hub parallel to the axis of the wheel and spaced circularly of the hub, the first blades being wedge-shaped and having sharp edges on the portions thereof which lead during rotation of the wheel, means for feeding and water into the top of the barrel, fixed annular means in the upper part of the barrel coaxial with the wheel for directing the cement and water to the first blades on the wheel.

2. Device according to claim 1, wherein the means for directing the cement and water to the first blades on the wheel has a plurality of second, radially inwardly concave scoop-shaped blades extending parallel to the axis of the wheel.

3. Device according to claim 2, wherein the lower ends of the second blades are disposed above and close to the upper ends of the first blades.

4. Device according to claim 1, wherein the acute angle between the outer side of the first blades and the direction of movement of blades lies between 5° and 30°.

5. Device according to claim 4, comprising means for driving the wheel with a peripheral speed in the range of from 10 m/sec. to 15 m/sec.

* * * * *